US005469346A

United States Patent [19]

Haut et al.

[11] Patent Number: 5,469,346

[45] Date of Patent: Nov. 21, 1995

[54] TIME SETTABLE FLASHING LIGHT

[75] Inventors: Paul R. Haut, 1240 Ridgeway Rd., Brookfield, Wis. 53045; William Schuster, Germantown, Wis.

[73] Assignee: Paul R. Haut, Menomonee Falls, Wis.

[21] Appl. No.: 143,922

[22] Filed: Oct. 26, 1993

[51] Int. Cl.[6] ..... F21L 7/00

[52] U.S. Cl. ..... 362/205; 362/186; 362/187; 362/208; 362/253; 315/360; 340/309.3; 340/321; 340/331; 368/256

[58] Field of Search ..... 315/200 A, 360; 368/256; 340/309.3, 309.4, 321, 331; 362/186, 187, 198, 202, 205, 208, 253

[56] References Cited

U.S. PATENT DOCUMENTS

| | | | |
|---|---|---|---|
| 3,202,979 | 8/1965 | Lemelson | 340/321 |
| 4,314,198 | 2/1982 | Rogers | 315/360 |
| 4,468,814 | 8/1984 | Field | 340/331 |
| 4,609,976 | 9/1986 | Geissler | 362/202 |
| 4,984,141 | 1/1991 | Lai et al. | 362/187 |
| 5,016,229 | 5/1991 | Gibbens, Jr. | 368/256 |
| 5,143,442 | 9/1992 | Ishikawa et al. | 362/205 |

*Primary Examiner*—Ira S. Lazarus

*Assistant Examiner*—Alan B. Cariaso

*Attorney, Agent, or Firm*—Ryan, Kees & Hohenfeldt

[57] ABSTRACT

A device which can be set to start a light flashing unattended at a predetermined time. The device includes a light and a battery, together with a small electronic clock. The clock has a display for displaying a time, a memory for holding a settable alarm time, and alarm output terminals for outputting a signal at a pre-established time stored in the memory. An electronic control circuit receives the signal from the clock at the pre-established time, and causes the light to begin flashing at that time. In the embodiment shown here, the control circuit flashes the light for a predetermined time, and then turns the light off. In this embodiment the device includes a casing, and a switch mounted in the casing and electrically connected between the battery and the light. By this switch, the light can be turned on and off in a manner generally conventional for a flashlight. The casing includes a telescopic slider, and a lens, mounted so that the lens is exposed when the casing is telescoped to be longer, and not exposed when the casing is telescoped to be shorter. A second switch is mounted to the telescopic slider. That second switch is electrically connected to the electronic control circuit so that, if the light is flashing, closing the telescopic slider stops the flashing of the light before the end of the predetermined time.

5 Claims, 2 Drawing Sheets

TIME SETTABLE FLASHING LIGHT

BACKGROUND OF THE INVENTION

This invention relates to flashlights, and in particular to those flashlights wherein the light can be made to flash on and off.

It is common for hunters to set up tree stands from which to wait for the animal being hunted to pass by. Once a tree stand is set up that way, it is desirable to leave it at dusk, and return to it before dawn the next day to begin hunting again. It is advantageous to return to the tree stand before dawn so as to already be in position to begin hunting with the first light of dawn. It is often difficult, however, to find one's tree stand in the pre-dawn darkness. One can of course use a conventional flashlight, so that one doesn't trip over obstacles on the way, but that doesn't solve the problem of finding the particular tree on which the stand is mounted.

There have been in the past flashlights and other portable lights which could be turned on and set to flash, including U.S. Pat. Nos. 2,695,403, 4,323,879 and 4,835,665. None of these portable lights, though, are capable of starting flashing at a predetermined time, without operator intervention at the time the flashing is desired. They could be turned on and left flashing in the tree stand all night, but that would be wasteful of battery power.

This invention relates to improvements over the apparatus set forth above and to solutions to the problems raised or not solved thereby.

SUMMARY OF THE INVENTION

The invention relates to a light which can be set to begin flashing at a predetermined time. The invention includes a light and a battery, which may be mounted in a casing. The invention also calls for a small electronic clock, which has a display for displaying a time, and a memory for holding a settable alarm time. The clock also has alarm output terminals for outputting a signal at a pre-established time stored in the memory. An electronic control circuit is mounted inside the casing for receiving the signal from the clock at the pre-established time, and causing the light to begin flashing at that time.

In one embodiment, a switch is mounted in the casing and electrically connected between the battery and the light. By this switch, the light is turned on and off in a manner generally conventional for a flashlight. The control circuit also includes a circuit portion that turns off the flashing of the light after a preset time interval. The casing of the light includes a telescopic slider so that the case can be made longer and shorter. The casing also includes a lens around the side, mounted so that it is exposed when the casing is telescoped to be longer, and not exposed when the casing is telescoped to be shorter. A second switch is mounted to the casing and coacts with the telescopic slider. That second switch is electrically connected to the electronic control circuit so that, if the light is flashing, closing the telescopic slider stops the flashing of the light before the end of the preset time interval. In fact, the second switch prevents the light from even beginning flashing at the predetermined time unless the casing is telescoped to be longer at that predetermined time.

Other objects and advantages of the invention will become apparent hereinafter.

DESCRIPTION OF THE PREFERRED EMBODIMENT

Figure 1:
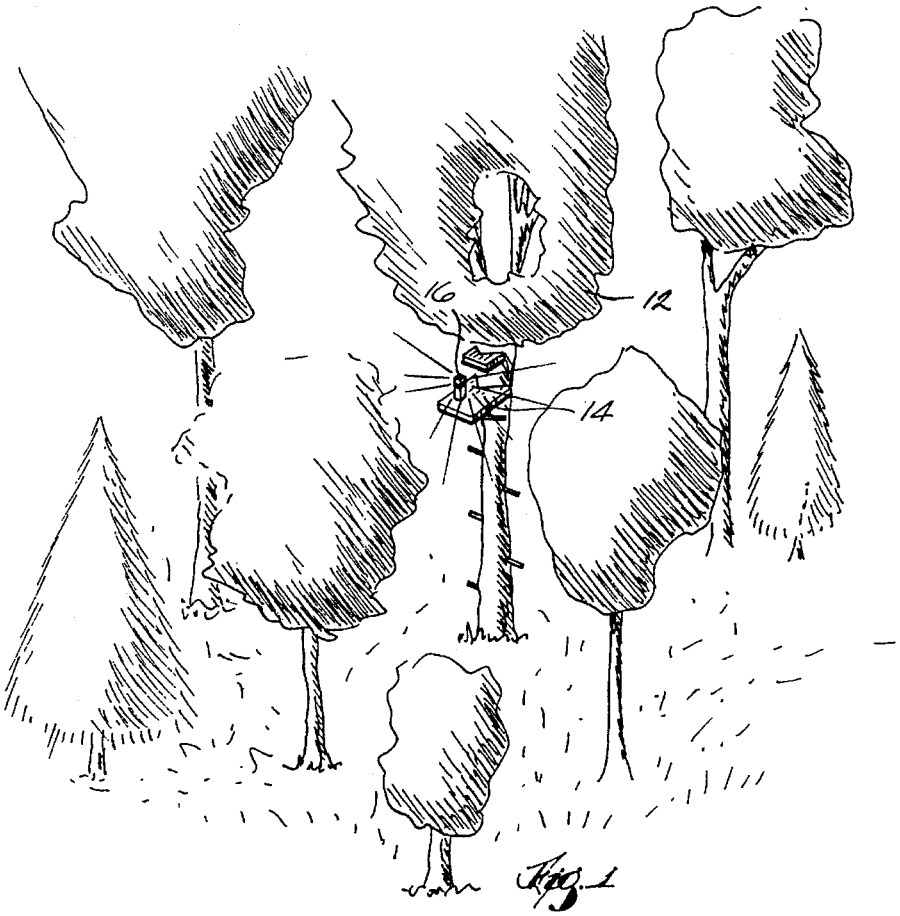
FIG. 1 is a perspective view of a portion of a forest, showing a device constructed according to a preferred embodiment of the invention in use on a tree stand.

Referring now to FIG. 1, there is shown a portion of a forest 10 with a number of trees 12. Mounted to one of the trees 12 is a tree stand 14. Resting on tree stand 14 is a time settable flashing light device 16 constructed according to a preferred embodiment of the invention.

Figure 2:
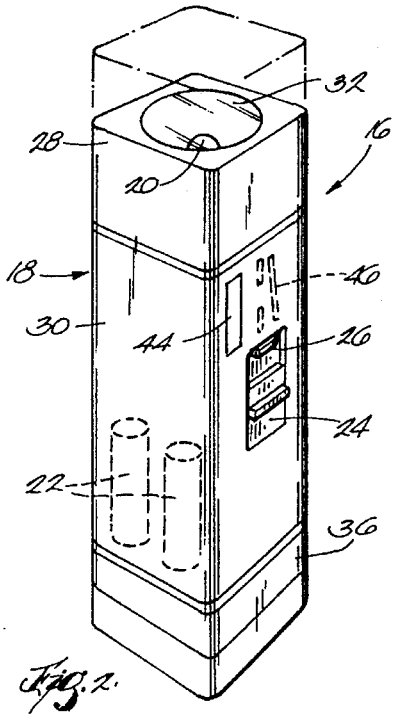
FIG. 2 is a perspective view of a device constructed according to one embodiment of the invention, showing in phantom the position of the end of the flashlight when telescoped outward.
Figure 3:
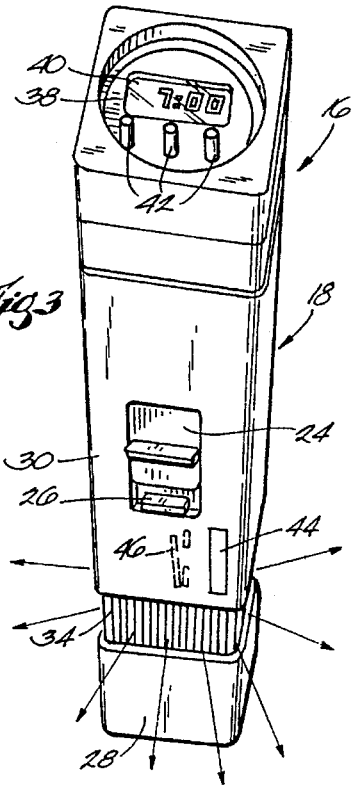
FIG. 3 is a perspective view similar to FIG. 2, with the device shown inverted and flashing.

FIGS. 2 and 3 show the device 16 in perspective view, on an enlarged scale compared to FIG. 1. As shown there, the device 16 includes a case 18 into which, or in association with which, the various parts may be mounted. The device 16 includes a light 20, such as a light bulb, mounted in the case. The light 20 is electrically connectable to one or more batteries 22, as a power source.

The invention further calls for an electronic clock 38, having a display window 40 and several control buttons 42. An electronic clock such as that shown in FIG. 3 is available from Jimestronics Co. Ltd., as the MG-05H LCD Module. The clock 38 includes an alarm function, with a memory location to store the alarm time, and alarm output terminals by means of which the clock transmits a signal at a predetermined time. Generally the clock 38 will have its own battery or power source, so that the battery 22 for powering the light 20 can be easily changed without losing the alarm information. The clock 38 is connected by a control circuit 44 to the light 20. One embodiment of the control circuit 44 will be described in detail presently. The simplest way to describe the function of the control circuit 44 is that it flashes the light 20 on and off, beginning on receiving the signal to do so from the clock. That way, a hunter can place the device 16 in his tree stand 14, set the alarm feature for a certain predetermined time, such as half an hour before the time the hunter knows to be dawn the next morning, and then go home for the night. The next morning he will be easily able to find his tree stand in the pre-dawn darkness by moving toward the flashing light. In the embodiment shown, the control circuit 44 will discontinue the flashing after a predetermined time period, for example, forty minutes. The exact length of the time period will be determined by selection of the values and tolerances of certain of the components in the control circuit, the strength of the battery 22, the ambient temperature.

In the embodiment shown in the drawing figures, device 16 also includes the function of a generally conventional flashlight. That is, the light 20 can be set to be continuously on, such as by means of a switch 25 (See FIG. 4) with a slide actuator 24 which can lock to an "on" position, or a momentary actuator 26. Both slide actuator 24 and momentary actuator 26 may be provided, for convenience.

Also in the embodiment shown, the case 18 is telescoping. That is, the case 18 includes a first end section 28 which can be slid partially into a main body section 30, or out of that section, thereby decreasing and increasing, respectively, the length of the case. In this embodiment, the light 20 is mounted and positioned so that, when the first end section 28 is telescoped in, the light bulb itself is appropriately positioned to coact with a cone mirror 32 so that the device 16 functions properly as a flashlight. The light 20 is mounted to the main body section 30, so that it does not move when the first end section 28 is telescoped out, but rather, remains in the same location. When the end section 28 is telescoped out, a lens 34 is exposed around the sides of the end section, and positioned about at the same lengthwise position as the light 20. The lens 34 is preferably tinted a certain color, such as amber, so that the light from the light bulb 20 will be altered in color.

A switch 46, which may be mounted in the main body section 30, is closed when the first end section 28 is telescoped out, and open when the first end section 28 is telescoped in. As will be shown, this switch 46 is a part of the control circuit 44, so that the flashing of the light 20 will only occur when the first end section 28 is telescoped out, and the flashing is stopped by telescoping the first end section in.

Figure 4:
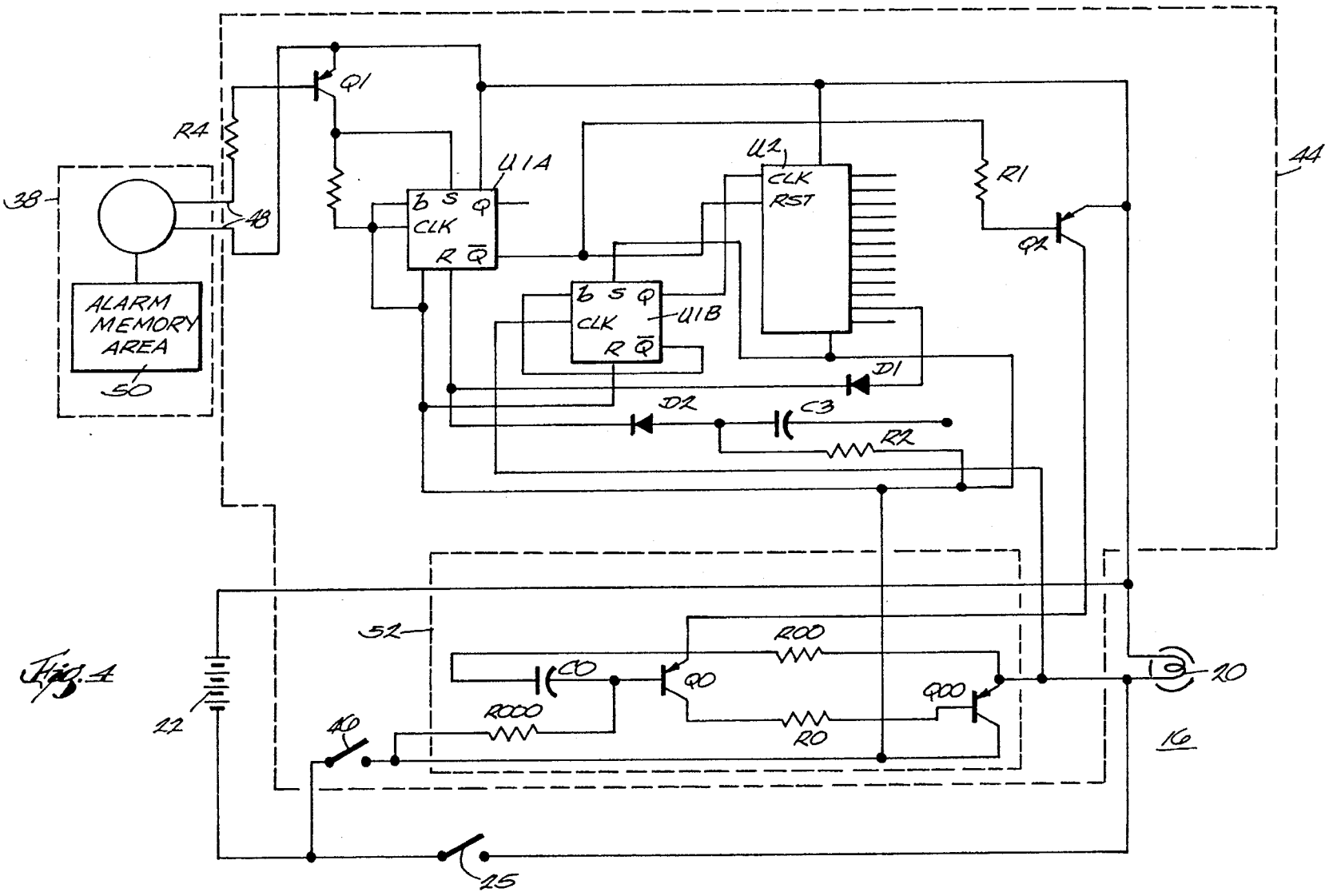
FIG. 4 is a schematic diagram of a control circuit constructed according to one embodiment of the invention.

Referring now to FIG. 4, the control circuit 44 is shown in detail. As there shown, the control circuit 44 connects into the electrical system of the device 16, which in this embodiment includes battery 22, light 20, and switch 25 for switching the light to a steady "on" state, rather than flashing. The control circuit 44 connects to alarm output terminals 48 of clock 38. As indicated above, the clock 38 includes an alarm memory area 50, for storing the time at which it is desired to have the flashing begin. When that time is reached, the clock 38 sends out a signal to the alarm output terminals 48. That signal turns on a transistor switch Q1, which in turn sends a signal into the SET terminal S of a latch U1A. Via its inverted output $\overline{Q}$, latch U1A then energizes a second transistor Q2. This second transistor Q2 connects the flashing circuit 52 to the battery 22 and light 20, causing the light to begin to flash. The flashing circuit 52 is a relatively conventional RC oscillation circuit with transistor switches Q0 and Q00, causing the light 20 to go on and off at a constant rate, which rate depends on the values and tolerances of capacitor C0 and resistors R0, R00 and R000. It has been determined that a rate of about one flash every 0.6 seconds is suitable.

The signal from flashing circuit 52 turning the light 20 on and off is also sent to another latch U1B, where the signal is squared up and divided by two. From there the signal is sent to a ripple counter U2, which will preferably be an integrated circuit, with the signal going to the CLK terminal of U2. Ripple counter U2 counts pulses from latch U1B, and outputs a signal after a suitable number of pulses. This signal from ripple counter U2 acts as a reset signal, resetting latch U1A, and the flashing stops. Assuming the desired flashing time is about forty minutes and the flashing frequency is about one flash every 0.6 seconds, as indicated in the examples given above, the ripple counter would issue the reset signal after it has received about 2048 pulses (corresponding to about 4096 flashes, since latch U1B divides the flashing signal by two).

Diodes D1 and D2 act together as an OR circuit, permitting the opening of switch 46 (by telescoping the first end section 28 in) to also reset the latch U1A and discontinue the flashing, as described above. Note that the inverted output $\overline{Q}$ of latch U1A, besides being connected to second transistor Q2, is also connected to the reset terminal RST of ripple counter U2. This is so that the ripple counter is reset every time the flashing is started, even in case the circuit was reset by switch 46 before the normal end of the flashing time interval.

Therefore the invention provides a fully portable light which, unlike any prior portable light, can be set to begin flashing, unattended, at a predetermined time. Further, in the embodiment here shown, the flashing can be turned off at will by the operator at any time, and the device also turns itself off after a certain length of time. In addition, the embodiment shown can also be used as a relatively conventional flashlight, and can even be started to flash on command, such as by pressing two of the control buttons 42, assuming the clock provides that function.

While the apparatus hereinbefore described is effectively adapted to fulfill the aforesaid objects, it is to be understood that the invention is not intended to be limited to the specific preferred embodiment of time settable flashing flashlight set forth above. Rather, it is to be taken as including all reasonable equivalents to the subject matter of the appended claims.

We claim:

1. In combination:

a light and a battery;

an electronic clock having a display for displaying a time, and having a memory area for holding a settable alarm time, and having alarm output terminals for outputting a signal at the time held in the memory area;

an electronic control circuit for receiving the signal from the clock and, on receipt of that signal, causing the light to alternately be connected to and disconnected from the battery, resulting in the light flashing on and off;

said control circuit including a circuit portion to discontinue the flashing of the light after a predetermined length of time flashing;

a casing body into which the light is mounted;

a telescopic slider slidably mounted to said casing body and having a cone mirror, and a lateral lens positioned around the sides of the telescopic slider, said telescopic slider having a telescoped-in position wherein the light is associated with the cone mirror, and a telescoped-out position wherein the light is associated with the lateral lens; and a telescoping switch mounted in association with the casing body and telescopic slider, said telescoping switch electrically connected to the electronic control circuit to prevent the electronic control circuit from beginning to flash the light at the predetermined time unless said telescopic slider is in its telescoped-out position, and to stop the flashing of the light before the end of the predetermined length of time when the telescopic slider is moved to its telescoped-in position.

2. A combination as recited in claim 1 further comprising an ON-OFF switch electrically connected between the battery and the light, and having an ON position to continuously connect the battery to the light and an OFF position to disconnect the battery from the light.

3. A combination as recited in claim 1 wherein the clock includes means for changing the time displayed and the time stored as the current time.

4. A flashlight comprising:

a casing having a casing body and a telescopic slider slidably mounted to said casing body, said telescopic slider having a cone mirror, and a lateral lens positioned around the sides of the telescopic slider;

a light mounted in the casing body, said telescopic slider having a telescoped-in position wherein the light is associated with the cone mirror, and a telescoped-out position wherein the light is associated with the lateral lens;

a battery mounted in the casing;

a first switch mounted in the casing and electrically connected between the battery and the light, and having an ON position to connect the battery to the light and an OFF position to disconnect the battery from the light;

an electronic clock mounted in the casing, and having a display for displaying a time, and having a memory area for holding a settable alarm time, and having alarm output terminals for outputting a signal at the time held in the memory area;

an electronic control circuit mounted to the casing for receiving the signal from the clock and causing the light to flash for a predetermined time and then turning the light off; and a second switch mounted in association with the casing body and telescopic slider, said second switch electrically connected to the electronic control circuit and configured to prevent the electronic control circuit from beginning to flash the light at the predetermined time unless said telescopic slider is in its telescoped-out position, and to stop the flashing of the light before the end of the predetermined length of time when the telescopic slider is moved to its telescoped-in position.

5. A flashlight as recited in claim 4 wherein the clock includes means for changing the time displayed and the time stored as the current time.

* * * * *